US006196859B1

(12) United States Patent
Garlarza

(10) Patent No.: US 6,196,859 B1
(45) Date of Patent: Mar. 6, 2001

(54) ELECTRICAL PLUG SOCKET RETAINER

(76) Inventor: Felix A. Garlarza, 24719 Marine Ave., Carson, CA (US) 90745

( * ) Notice: Subject to any disclaimer, the term of this patent is extended or adjusted under 35 U.S.C. 154(b) by 0 days.

(21) Appl. No.: 09/288,123

(22) Filed: Apr. 8, 1999

(51) Int. Cl.[7] ..... H01R 13/62
(52) U.S. Cl. ..... 439/369
(58) Field of Search ..... 439/369, 371, 439/373

(56) References Cited

U.S. PATENT DOCUMENTS 3,281,755 * 10/1966 Trager .
4,076,360 * 2/1978 Singh ..... 339/36
4,531,800 * 7/1985 Avener ..... 339/75
5,649,835 * 7/1997 Weed ..... 439/320

* cited by examiner

*Primary Examiner*—Brian Sircus
*Assistant Examiner*—Thanh-Tam Le

(57) ABSTRACT

A electrical plug socket retainer for securing an electrical plug to an electrical receptacle socket so that the electrical plug is not easily pulled out of the receptacle. The electrical plug socket retainer includes an end wall with a slot and an arcuate side wall outwardly extended from one face of the end wall. The side wall has a free end opposite the end wall with an exterior threaded portion. A threaded nut has a threaded interior into which the threaded portion of the side wall may be threadably inserted.

5 Claims, 2 Drawing Sheets

ELECTRICAL PLUG SOCKET RETAINER

BACKGROUND OF THE INVENTION

1. Field of the Invention

The present invention relates to electrical plug socket retainers and more particularly pertains to a new electrical plug socket retainer for securing an electrical plug to an electrical receptacle socket so that the electrical plug is not easily pulled out of the receptacle.

2. Description of the Prior Art

The use of electrical plug socket retainers is known in the prior art. More specifically, electrical plug socket retainers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,659,059; U.S. Pat. No. 3,811,104; U.S. Pat. No. 4,183,603; U.S. Pat. No. 4,183,603; U.S. Pat. No. Des. 325,564; U.S. Pat. No. 4,662,697; and U.S. Pat. No. 4,664,463.

While these devices fulfill their respective, particular objectives and requirements, the aforementioned patents do not disclose a new electrical plug socket retainer. The inventive device includes an end wall with a slot and an arcuate side wall outwardly extended from one face of the end wall. The side wall has a free end opposite the end wall with an exterior threaded portion. A threaded nut has a threaded interior into which the threaded portion of the side wall may be threadably inserted.

In these respects, the electrical plug socket retainer according to the present invention substantially departs from the conventional concepts and designs of the prior art, and in so doing provides an apparatus primarily developed for the purpose of securing an electrical plug to an electrical receptacle socket so that the electrical plug is not easily pulled out of the receptacle.

SUMMARY OF THE INVENTION

In view of the foregoing disadvantages inherent in the known types of electrical plug socket retainers now present in the prior art, the present invention provides a new electrical plug socket retainer construction wherein the same can be utilized for securing an electrical plug to an electrical receptacle socket so that the electrical plug is not easily pulled out of the receptacle.

The general purpose of the present invention, which will be described subsequently in greater detail, is to provide a new electrical plug socket retainer apparatus and method which has many of the advantages of the electrical plug socket retainers mentioned heretofore and many novel features that result in a new electrical plug socket retainer which is not anticipated, rendered obvious, suggested, or even implied by any of the prior art electrical plug socket retainers, either alone or in any combination thereof.

To attain this, the present invention generally comprises an end wall with a slot and an arcuate side wall outwardly extended from one face of the end wall. The side wall has a free end opposite the end wall with an exterior threaded portion. A threaded nut has a threaded interior into which the threaded portion of the side wall may be threadably inserted.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrical plug socket retainer apparatus and method which has many of the advantages of the electrical plug socket retainers mentioned heretofore and many novel features that result in a new electrical plug socket retainer which is not anticipated, rendered obvious, suggested, or even implied by any of the prior art electrical plug socket retainers, either alone or in any combination thereof.

It is another object of the present invention to provide a new electrical plug socket retainer which may be easily and efficiently manufactured and marketed.

It is a further object of the present invention to provide a new electrical plug socket retainer which is of a durable and reliable construction.

An even further object of the present invention is to provide a new electrical plug socket retainer which is susceptible of a low cost of manufacture with regard to both materials and labor, and which accordingly is then susceptible of low prices of sale to the consuming public, thereby making such electrical plug socket retainer economically available to the buying public.

Still yet another object of the present invention is to provide a new electrical plug socket retainer which provides in the apparatuses and methods of the prior art some of the advantages thereof, while simultaneously overcoming some of the disadvantages normally associated therewith.

Still another object of the present invention is to provide a new electrical plug socket retainer for securing an electrical plug to an electrical receptacle socket so that the electrical plug is not easily pulled out of the receptacle.

Yet another object of the present invention is to provide a new electrical plug socket retainer which includes an end wall with a slot and an arcuate side wall outwardly extended from one face of the end wall. The side wall has a free end opposite the end wall with an exterior threaded portion. A threaded nut has a threaded interior into which the threaded portion of the side wall may be threadably inserted.

Still yet another object of the present invention is to provide a new electrical plug socket retainer that is threadably insertable into a face plate of a receptacle to secure it to the face plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
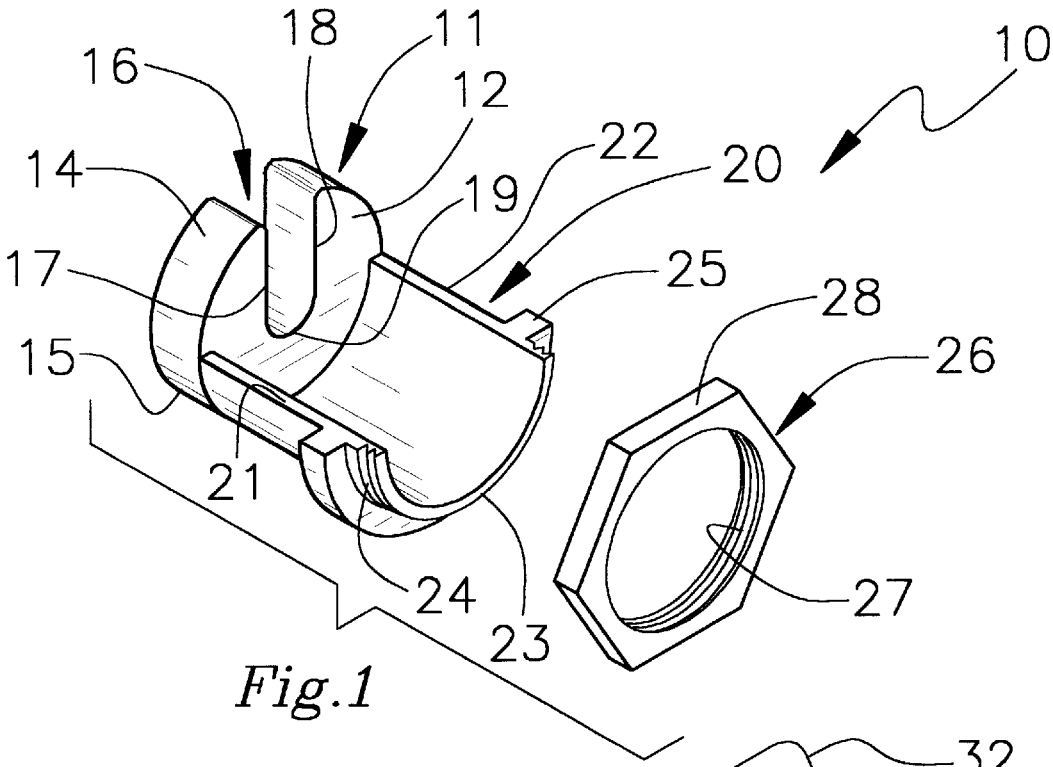
FIG. 1 is a schematic perspective view of a new electrical plug socket retainer according to the present invention.

With reference now to the drawings, and in particular to FIGS. 1 through 5 thereof, a new electrical plug socket retainer embodying the principles and concepts of the present invention and generally designated by the reference numeral 10 will be described.

As best illustrated in FIGS. 1 through 5, the electrical plug socket retainer 10 generally comprises an end wall with a slot and an arcuate side wall outwardly extended from one face of the end wall. The side wall has a free end opposite the end wall with an exterior threaded portion. A threaded nut has a threaded interior into which the threaded portion of the side wall may be threadably inserted.

In closer detail, the retainer 10 comprises a generally circular disk-shaped end wall 11 having has a center, a pair of generally circular faces 12,13 and a generally circular outer perimeter. The outer perimeter of the end wall has a pair of generally semi-circular regions 14,15.

The end wall has a slot 16 through the faces of the end wall and extending from a first of the regions 14 of the outer perimeter of the end wall towards the center of the end wall. The slot of the end wall has a generally U-shaped periphery comprising a pair of substantially parallel sides 17,18 and an arcuate end 19 connecting the sides of the slot together. The arcuate end of the slot is preferably concentrically positioned about the center of the end wall.

A generally C-shaped arcuate side wall 20 is outwardly extended substantially perpendicularly from one of the faces of the end wall. The side wall has a generally semi-circular transverse cross section taken in a plane lie substantially parallel to the one face of the end wall. The side wall is extended along a second of the regions 15 of the outer perimeter of the end wall such that the side wall has a concavity facing towards the first region of the outer perimeter of the end wall. This way the side wall has an outer radius about equal to an outer radius of the end wall defined from the center of the end wall and the outer perimeter of the end wall. The concavity of the side wall defining an axis of the side wall which is coaxial with the center of the end wall.

The side wall has a pair of substantially straight side edges 21,22 extending therealong substantially perpendicular to the end wall. The side edges of the side wall preferably lie in a common plane with one another.

The side wall has a generally semi-circular arcuate free end 23 opposite the end wall. The side wall also has an exterior threaded portion 24 adjacent the free end of the side wall. Preferably, the side wall further includes a generally semi-circular arcuate outwardly radiating stop flange 25 adjacent the exterior threaded portion such that the exterior threaded portion is interposed between the stop flange and the free end of the side wall. Preferably, the stop flange has a radius greater than the radius of the end wall.

The retainer also comprises a threaded nut 26 having a threaded interior 27 and a preferably hexagonal shaped exterior 28. The threaded portion of the side wall is threadably insertable into the threaded interior of the threaded nut.

In use, the retainer 10 is for securing a plug 29 at the end of an electrical cord 30 to an electrical receptacle 31 into which the plug is inserted. In particular, an electrical receptacle has a face plate 32 covering the receptacle with at least one hole 33 therethrough providing an opening to a socket 34 of the receptacle. The plug is extended through the hole of the face plate and inserted into the socket of the receptacle to electrically connect the plug to the receptacle.

Figure 2:
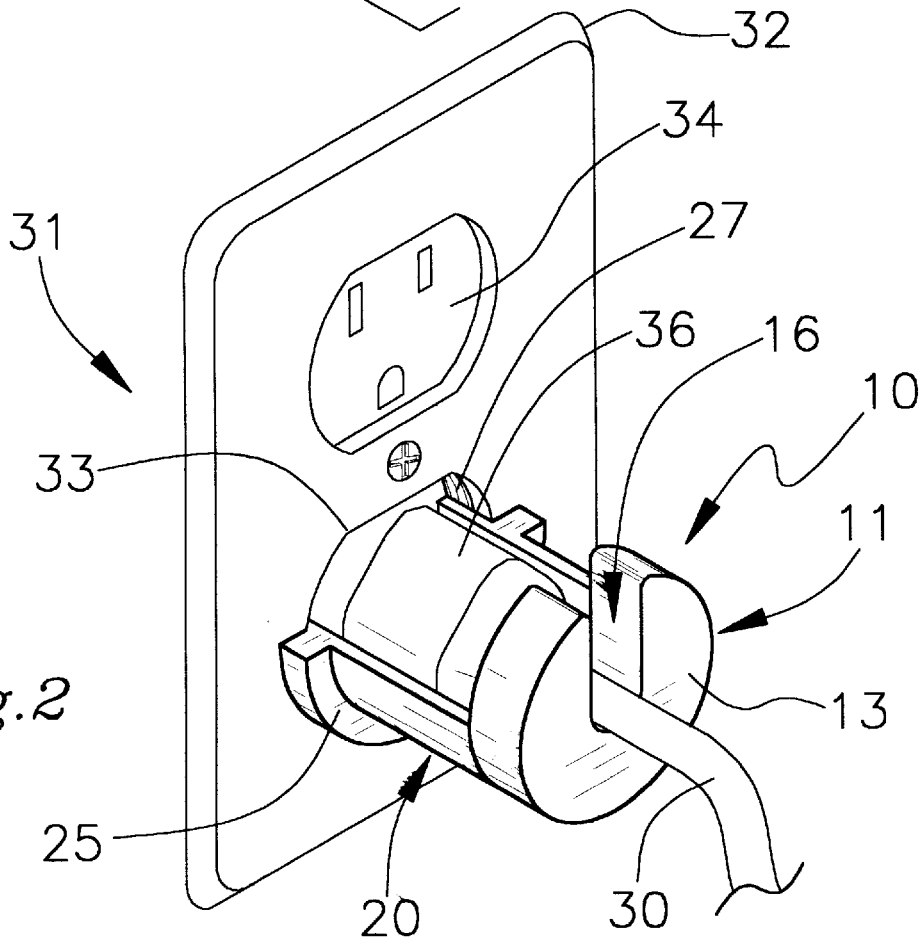
FIG. 2 is a schematic perspective view of the present invention in use.

The threaded nut is positioned between the receptacle and the face plate such that the threaded interior of the threaded nut is disposed around the socket of the receptacle and a portion of the plug inserted into the socket. The plug is then positioned in a space defined by the side wall with the electrical cord extending through the slot of the end wall as illustrated in FIG. 2. The free end of the side wall is inserted through the hole of the face plate and the exterior threaded portion is threadably inserted into the threaded interior of the threaded nut. As the side wall is rotated to insert it into the nut, the side wall is rotated around the plug and the slot is rotated about the electrical cord so that the electrical cord is not twisted. With the side wall is attached to the nut, the face plate is interposed between the threaded nut and the stop flange of the side wall and the side wall outwardly extending from the face plate and the end wall is spaced apart from the face plate.

Figure 3:
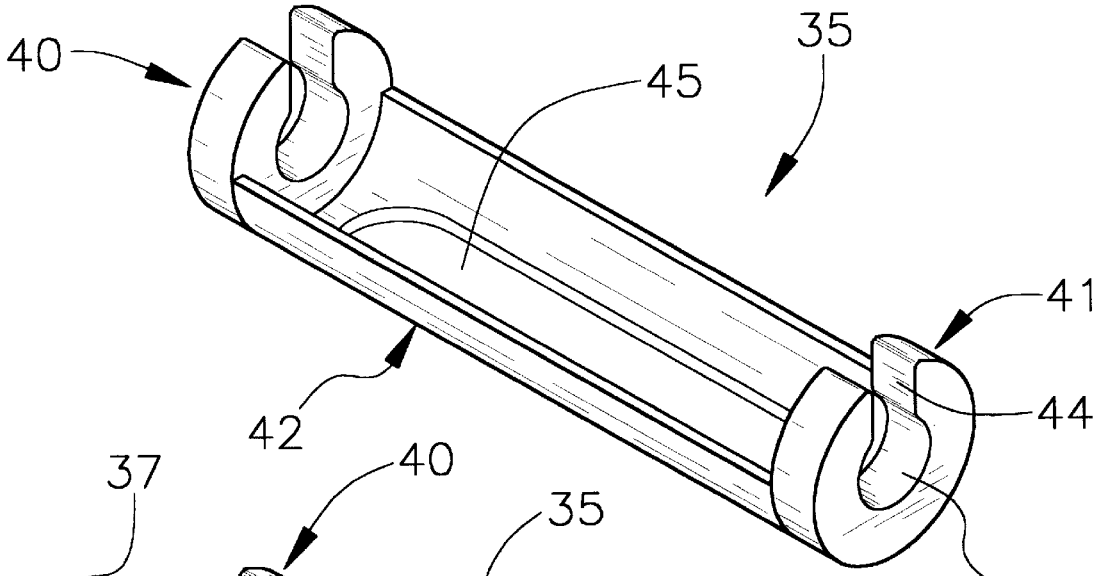
FIG. 3 is a schematic perspective view of a plug retainer embodiment of the present invention.
Figure 4:
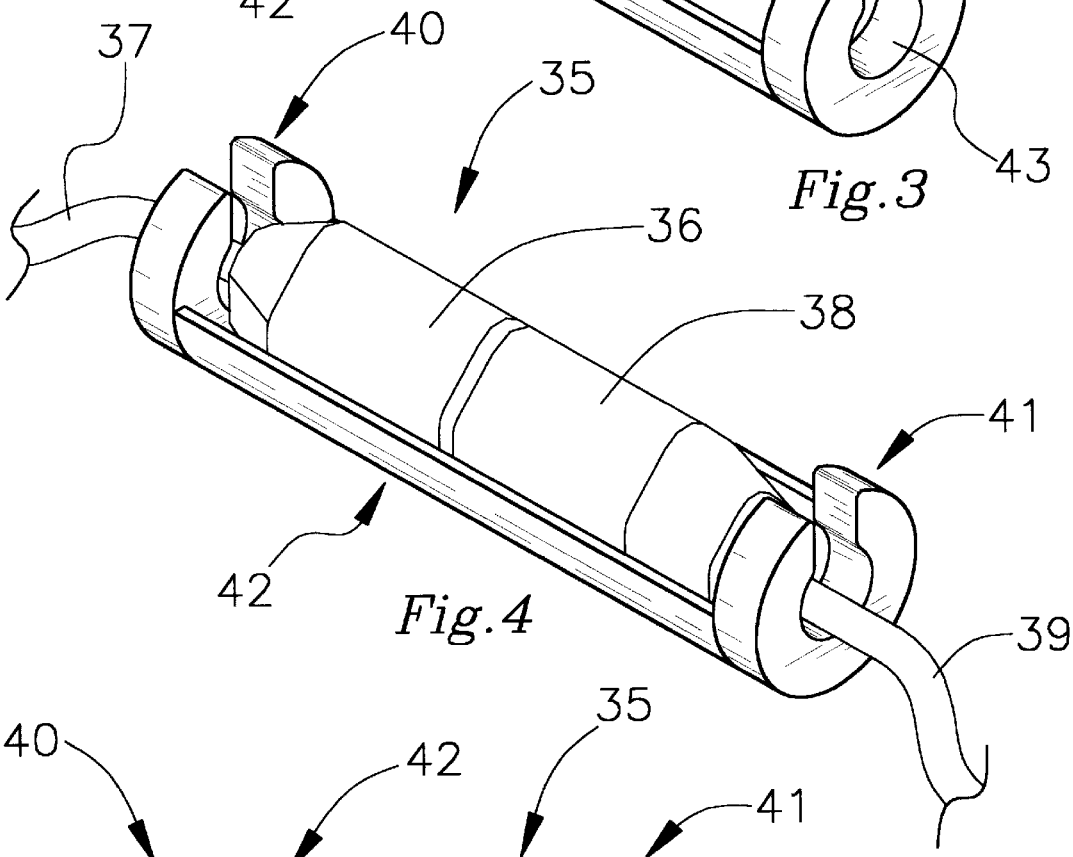
FIG. 4 is a schematic perspective view of the plug retainer embodiment of the present invention in use.

FIGS. 3 and 4 illustrate a plug retainer embodiment 35 of the invention for securing a plug 36 of a first electric cord 37 to a socket 38 of a second electric cord 39. The plug retainer comprises a spaced apart pair of generally C-shaped end walls 40,41 coaxially aligned with one another and an arcuate side wall 42 extending between the end wall to connect the end walls together. The end walls each define a center hole 43 and a break 44 providing an opening into the center hole of the respective end wall.

Figure 5:
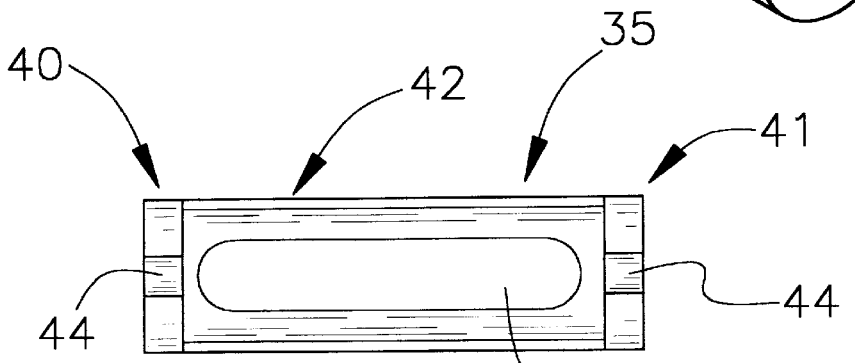
FIG. 5 is a schematic top view of the plug retainer embodiment of the present invention.

The side wall is preferably positioned in a region opposite the breaks of the end walls such that the side wall has a concavity facing the breaks. The side wall also has a generally oblong elongate hole 45 therethrough extending between the end walls. The elongate hole preferably has an longitudinal axis substantially parallel to an axis defined by centers of the end walls. The elongate hole also preferably has a pair of generally semi-circular rounded ends as best illustrated in FIG. 5.

As best illustrated in FIG. 4, in use, the side wall defines a space between the end walls designed for receiving a plug of a first electrical cord and a socket of a second electrical cord into which the plug of the first electrical cord is inserted. A portion of the plug and socket are extended into the elongate hole of the side wall. The first electrical cord is extended through the center hole of one of the end walls and the second electrical cord is extended through the center hole of the other end wall. This arrangement helps keep the plug attached to the socket when the first and second cords are pulled in opposite directions from each other.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retainer system for securing a plug at the end of an electrical cord to an electrical receptacle into which the plug is inserted, said retainer system comprising:

a retainer, comprising:

an end wall having a center, a pair of faces and an outer perimeter;

said end wall having a slot extending from said outer perimeter of said end wall towards said center of said end wall;

a side wall being outwardly extended from one of said faces of said end wall;

said side wall having a free end opposite said end wall;

said side wall having an exterior threaded portion adjacent said free end of said side wall;

a threaded nut having a threaded interior, said threaded portion of said side wall being adapted for threadable insertion into said threaded interior of said threaded nuts and wherein said side wall has an outwardly radiating stop flange adjacent said exterior threaded portion such that said exterior threaded portion is interposed between said stop flange and said free end of said side wall.

2. The retainer system of claim 1, wherein said outer perimeter of said end wall has a pair of regions, said slot being located in one region of said end wall, said side wall being extended along the other region of said end wall opposite said one region.

3. The retainer system of claim 1, wherein said side wall has a pair of substantially straight side edges extending therealong substantially perpendicular to said end wall, said side edges of said side wall lying in a common plane with one another.

4. A retainer system for securing a plug at the end of an electrical cord to an electrical receptacle into which the plug is inserted, said retainer system comprising:

a retainer, comprising:

a generally circular disk-shaped end wall having a center, a pair of generally circular faces and a generally circular outer perimeter;

said outer perimeter of said end wall having a pair of generally semi-circular regions;

said end wall having a slot through said faces of said end wall and extending from a first region of said outer perimeter of said end wall towards said center of said end wall;

said slot of said end wall having a generally U-shaped periphery comprising a pair of substantially parallel sides and an arcuate end connecting said sides of said slot together, said arcuate end of said slot being concentrically positioned about said center of said end wall;

a generally C-shaped arcuate side wall being outwardly extended from one of said faces of said end wall, said side wall having a generally semi-circular transverse cross section taken in a plane lying substantially parallel to said one face of said end wall;

said side wall being extended along a second of said regions of said outer perimeter of said end wall such that said side wall has a concavity facing towards said first region of said outer perimeter of said end wall;

said concavity of said side wall defining an axis of said side wall, said axis of said side wall being coaxial with said center of said end wall;

said side wall having a pair of substantially straight side edges extending therealong substantially perpendicular to said end wall, said side edges of said side wall lying in a common plane with one another;

said side wall having a free end opposite said end wall;

said side wall having an exterior threaded portion adjacent said free end of said side wall;

said side wall having an generally outwardly radiating stop flange adjacent said exterior threaded portion such that said exterior threaded portion is interposed between said stop flange and said free end of said side wall;

a threaded nut having a threaded interior and an hexagonal shaped exterior;

an electrical receptacle having a face plate covering said receptacle, said face plate having at least one hole therethrough providing an opening to a socket of said receptacle;

an electrical cord having a plug at one end of said cord, said plug being extended through said hole of said face plate and inserted into said socket of said receptacle to electrically connect said plug to said receptacle;

said threaded nut being positioned between said receptacle and said face plate such that said threaded interior of said threaded nut is disposed around said socket of said receptacle and a portion of said plug inserted into said socket;

said plug being position in a space defined by said side wall, said electrical cord being extended through said slot of said end wall;

said free end of said side wall being inserted through said hole of said face plate and said exterior threaded portion being threadably inserted into said threaded interior of said threaded nut; and said face plate being interposed between said threaded nut and said stop flange of said side wall and said side wall outwardly extending from said face plate and said end wall is spaced apart from said face plate.

5. A plug retainer for securing a plug of a first electric cord to a socket of a second electric cord, comprising:

a spaced apart pair of generally C-shaped end walls coaxially aligned with one another;

an arcuate side wall extending between said end wall to connect said end walls together;

said end walls each defining a center hole and a break providing an opening into said center hole of the respective end wall;

said side wall being positioned in a region opposite said breaks of said end walls such that said side wall has a concavity facing said breaks;

said side wall having a generally oblong elongate hole therethrough extending between said end walls, said elongate hole having an longitudinal axis substantially parallel to an axis defined by centers of said end walls, said elongate hole having a pair of generally semicircular rounded ends; and said side wall defining a space between said end walls adapted for receiving the plug of the first electrical cord and the socket of the second electrical cord into which the plug of the first electrical cord is inserted, a portion of the plug and socket being extended into said elongate hole of said side wall such that the first electrical cord is extended through said center hole of one of said end walls and the second electrical cord is extended through said center hole of said other end wall.

* * * * *